US006021533A

United States Patent [19]

Ellis et al.

[11] Patent Number: 6,021,533

[45] Date of Patent: Feb. 8, 2000

[54] MATTRESS APPARATUS HAVING A SIDERAIL DOWN SENSOR

[75] Inventors: Craig D. Ellis; Kenith W. Chambers; Stephen E. Glover, all of Charleston; Kerry J. Mensching, Mt. Pleasant, all of S.C.

[73] Assignee: Hill-Rom, Inc., Batesville, Ind.

[21] Appl. No.: 08/917,145

[22] Filed: Aug. 25, 1997

[51] Int. Cl.[7] ..... A47C 21/08; A61G 7/00

[52] U.S. Cl. ..... 5/600; 5/425; 5/430

[58] Field of Search ..... 5/600, 424, 425, 5/430, 940, 713

[56] References Cited

U.S. PATENT DOCUMENTS

| | | | |
|---|---|---|---|
| 2,644,173 | 7/1953 | James | 5/424 |
| 2,734,104 | 2/1956 | Gollhofer | 5/940 |
| 3,018,492 | 1/1962 | Rosen | 5/946 |
| 3,321,779 | 5/1967 | Kaufman et al. | 5/946 |
| 3,742,530 | 7/1973 | Clark | 5/663 |
| 3,877,090 | 4/1975 | Schutz | 5/946 |
| 4,231,030 | 10/1980 | Weiss | 5/940 |
| 4,232,415 | 11/1980 | Webber | 5/427 |
| 4,477,935 | 10/1984 | Griffin | 5/241 |
| 4,525,885 | 7/1985 | Hunt et al. | 5/713 |
| 4,527,298 | 7/1985 | Moulton | 5/615 |
| 4,670,923 | 6/1987 | Gabriel et al. | 5/424 |
| 4,825,486 | 5/1989 | Kimura et al. | 5/713 |
| 4,873,734 | 10/1989 | Pollard | 5/425 |
| 4,914,760 | 4/1990 | Hargest et al. | 5/689 |
| 4,926,457 | 5/1990 | Poehner et al. | 5/601 |
| 4,987,623 | 1/1991 | Stryker et al. | 5/86.1 |
| 4,993,920 | 2/1991 | Harkeroad et al. | 5/713 |
| 5,029,352 | 7/1991 | Hargest et al. | 5/689 |
| 5,035,014 | 7/1991 | Blanchard | 5/424 |
| 5,044,025 | 9/1991 | Hunsinger et al. | 5/663 |
| 5,065,464 | 11/1991 | Blanchard et al. . | |
| 5,068,933 | 12/1991 | Sexton | 5/644 |
| 5,077,843 | 1/1992 | Dale et al. | 5/185 |
| 5,083,332 | 1/1992 | Foster et al. | 5/185 |
| 5,121,512 | 6/1992 | Kaufmann | 5/713 |
| 5,121,756 | 6/1992 | Koledin | 128/870 |
| 5,168,589 | 12/1992 | Stroh et al. . | |
| 5,179,744 | 1/1993 | Foster et al. | 5/600 |
| 5,191,663 | 3/1993 | Holder et al. | 5/425 |
| 5,325,551 | 7/1994 | Tappel et al. | 5/713 |
| 5,377,370 | 1/1995 | Foster et al. | 5/620 |
| 5,394,580 | 3/1995 | Foster et al. | 5/430 |
| 5,421,046 | 6/1995 | Vande Streek | 5/663 |
| 5,450,641 | 9/1995 | Montgomery | 5/663 |
| 5,481,772 | 1/1996 | Glynn et al. | 5/663 |
| 5,483,709 | 1/1996 | Foster et al. | 8/81.1 R |
| 5,522,100 | 6/1996 | Schilling et al. | 5/86.1 |
| 5,542,136 | 8/1996 | Tappel | 5/710 |
| 5,586,346 | 12/1996 | Stacy et al. | 5/710 |
| 5,611,096 | 3/1997 | Bartlett et al. | 5/713 |

FOREIGN PATENT DOCUMENTS

| | | |
|---|---|---|
| 2 199 803 | 7/1988 | United Kingdom . |
| WO 94/09686 | 5/1994 | WIPO . |

*Primary Examiner*—Alexander Grosz
*Attorney, Agent, or Firm*—Barnes & Thornburg

[57] ABSTRACT

A mattress apparatus is provided for use on a bed frame having at least one siderail movable from an up position to a down position. The apparatus includes a support surface, an electrical controller configured to control the support surface, and a siderail down sensor configured to be coupled to one of the bed frame and siderail. The siderail down sensor is electrically coupled to the controller. The siderail down sensor is configured to generate an output signal indicating that the siderail of the bed frame is in the down position.

7 Claims, 6 Drawing Sheets

MATTRESS APPARATUS HAVING A SIDERAIL DOWN SENSOR

BACKGROUND AND SUMMARY OF THE INVENTION

The present invention relates to a mattress assembly for use on a hospital bed. More particularly, the present invention relates to a replacement mattress assembly which can be used on various types of bed frames to provide improved patient support and therapies.

The mattress assembly of the present invention is a mattress replacement which can be used on various types of frames to provide improved patient support and therapy. The mattress includes a support surface having an external cover defining an interior region. A plurality of air cushions are located within the interior region. The interior region also includes valves located at a head end of the mattress and an air intake manifold and percussion/vibration valve at a foot end of the mattress. Cloth tubes are configured to couple the air inlet manifold to the valves at the head end of the mattress. These cloth tubes are very flexible and reduce the likelihood of kinking when the mattress is articulated on a bed frame.

The mattress assembly is designed to facilitate transfer of the mattress assembly from one bed frame to another. A plurality of low friction plates are located on a bottom surface of the mattress. The plates are formed to include apertures and handles to facilitate movement of the mattress from one bed frame to another by a caregiver. The mattress also includes extension cushions on opposite side portions of the mattress. These cushions can be selectively inflated and deflated depending upon the width of the bed frame on which the mattress is located. Illustratively, the valve is used to selectively inflate and deflate the extension cushions.

Also illustratively, therapy controls are input into the system using a touch screen formed integrally with a blower housing. An operator can input commands into a main microprocessor using the touch screen input display. Signals are transmitted from the main microprocessor to a valve controller within the mattress assembly using an electrical cable which extends between the housing and the controller. In the illustrated embodiment, the electrical cable extends through the interior region of an air hose connected between the blower housing and the inlet manifold within the mattress. Running the electrical cable through the interior region of the air hose reduces clutter and reduces likelihood that the electrical cable will be inadvertently disconnected.

The mattress assembly is configured to provide various types of therapy for a patient located on the mattress. For instance, percussion vibration therapy and rotation therapy can be provided to the patient. The apparatus includes a siderail down sensor configured to be coupled to the bed frame or directly to the siderail of the bed to generate an output signal when the siderail is down. The output signal is delivered to the microprocessor to deactivate a particular therapy, such as the rotation therapy, if the siderail is down.

According to one aspect of the present invention, an apparatus is provided for controlling inflation and deflation of an air mattress including at least one air bladder, a valve, and a controller for the valve. The apparatus includes a housing formed to include an air inlet and an air outlet, an air supply located within the housing, and an electrical user input located on the housing. The electrical input is configured to generate a control signal for the valve controller. The apparatus also includes an air hose having a first end coupled to the outlet of the housing and a second end coupled to the valve. The hose has an interior region configured to conduct air from the air supply to the valve. The apparatus further includes an electrical cable having a first end coupled to the housing and a second end coupled to the controller. The cable is located at least partially within the interior region of the hose.

In the illustrated embodiment, the cable includes first and second electrical connectors at the first and second ends, respectively. The first electrical connector is coupled to a connector on the housing outside the interior region of the hose, and the second electrical connector is coupled to the controller outside the interior region of the hose. A center portion of the cable is located within the interior region of the hose.

The illustrated hose includes first and second fittings at the first and second ends, respectively. The first and second fittings are configured to engage the cable to provide strain relief adjacent the first and second ends of the cable.

The apparatus further includes an air intake manifold coupled to the air inlet. The manifold includes a wall defining a bottom opening. The manifold is configured to change the direction of intake air entering the housing to reduce the intake noise of the intake air. A filter is coupled to the air manifold. A foam material is coupled to the wall of the manifold within an interior region of the manifold.

According to another aspect of the present invention, an air mattress includes a cover defining an interior region, at least one air bladder located in the interior region, an air manifold having an inlet configured to receive air from an air supply and an outlet, a valve having an inlet and an outlet coupled to the at least one air bladder, and a cloth tube having a first end coupled to the outlet of the manifold and a second end coupled to the inlet of the valve. The manifold, valve, and cloth tube are all located within the interior region.

The illustrated mattress includes a plurality of air bladders and first and second valves having a plurality of outputs coupled to the plurality of air bladders. The first cloth tube extends from the manifold to the first valve. The apparatus also includes a second cloth tube having a first end coupled to the outlet of the manifold and a second end coupled to an inlet of the second valve. In the illustrated embodiment a mesh liner is located within each cloth tube.

According to yet another aspect of the present invention, a mattress is configured to be located on a bed frame. The mattress includes a support surface having a head end, a foot end, and spaced apart first and second side portions. The mattress also includes an air bladder coupled to and extending along the first side of the support surface. The air bladder is inflatable and deflatable to adjust the width of the mattress.

In the illustrated embodiment, the mattress includes a second air bladder coupled to and extending along the second side portion of the support surface. The second air bladder is inflatable and deflatable to adjust the width of the mattress. The first and second air bladders are illustratively coupled to an exterior portion of the support surface.

In the illustrated embodiment, the support surface includes a plurality of air bladders located within an interior region of the support surface and a cover surrounding the plurality of air bladders. The first and second air bladders being located outside the cover.

Also in the illustrated embodiment, a valve is configured to be coupled to an air supply. The valve has an output coupled to the first and second air bladders for selectively inflating and deflating the first and second air bladders based on the width of the frame. The valve is configured to normally inflate the first and second air bladders. A second valve is also coupled to the first and second air bladders for manually removing air from the first and second air bladders upon actuation of the second valve.

According to a further aspect of the present invention, a support apparatus includes a mattress having a top surface configured to support a body and a bottom surface. The apparatus also includes at least one plate coupled to the bottom surface of the mattress to facilitate transfer of the mattress from one bed frame to another bed frame.

In the illustrated embodiment, the plate is made from a low friction plastic material. A plurality of plates are illustratively coupled to the bottom surface of the mattress. The plates have a rectangular shape and includes first and second ends located adjacent first and second side portions of the mattress. The plates are formed to include a plurality of apertures. The plates are also formed to include first and second handles adjacent the first and second ends.

According to a still further aspect of the present invention, a replacement mattress apparatus is provided for use on a bed frame having at least one siderail movable from an up position to a down position. The apparatus includes a support surface, an electrical controller configured to control the support surface, and a siderail down sensor configured to be coupled to one of the bed frame and siderail. The siderail down sensor is electrically coupled to the controller. The siderail down sensor is configured to generate an output signal indicating that the siderail of the bed frame is in the down position.

The siderail down sensor may include, for example, a mercury switch, a ball switch, or an accelerometer. In one illustrated embodiment, the siderail down sensor includes a switch and an attachment mechanism configured to couple the sensor to the bed frame adjacent the siderail. The siderail is configured to actuate the switch and generate an output signal as the siderail moves from an up position to a down position. The switch of the siderail down sensor is configured to be closed when the siderail is in the up position.

In another illustrated embodiment, the siderail down sensor includes first and second plates slidable relative to each other. The first and second plates are spring biased together to clamp the siderail down sensor to the siderail.

According to an additional embodiment of the present invention, a mattress includes a support surface having a head end, a foot end, and spaced apart first and second side portions. The support surface includes at least one air cushion having separately inflatable first and second outer sections located adjacent the first and second side portions of the support surface, respectively, and an inner section located between the first and second outer sections. The mattress also includes a valve having an air inlet configured to be coupled to an air supply, and at least two outlets coupled to the first and second outer sections and the inner section. The mattress further includes a controller coupled to the valve. The controller is configured to reduce the pressure of the inner section of the air cushion to a pressure less than a pressure in the first and second outer sections to maintain a body on the support surface positioned over the inner portion during transport of the support surface.

In the illustrated embodiment, the support surface includes a head cushion, a seat cushion, and a foot cushion which each include the first and second outer sections and the inner sections which are separately inflatable. A chest cushion is located between the head cushion and the seat cushion. The chest cushion is formed to include a plurality of percussion/vibration bladders coupled to a percussion/vibration valve.

Also in the illustrated embodiment, the support surface includes at least one lower air cushion situated below the head cushion, the seat cushion, and the foot cushion within the support surface. The at least one lower air cushion remains inflated during deflation of the inner sections during transport. First and second rotation bladders are located below the at least one lower air cushion within the support surface. The first and second rotation bladders are coupled to outputs from the valve. The controller is configured to inflate and deflate the rotation bladders to provide rotation therapy to the body on the support surface.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
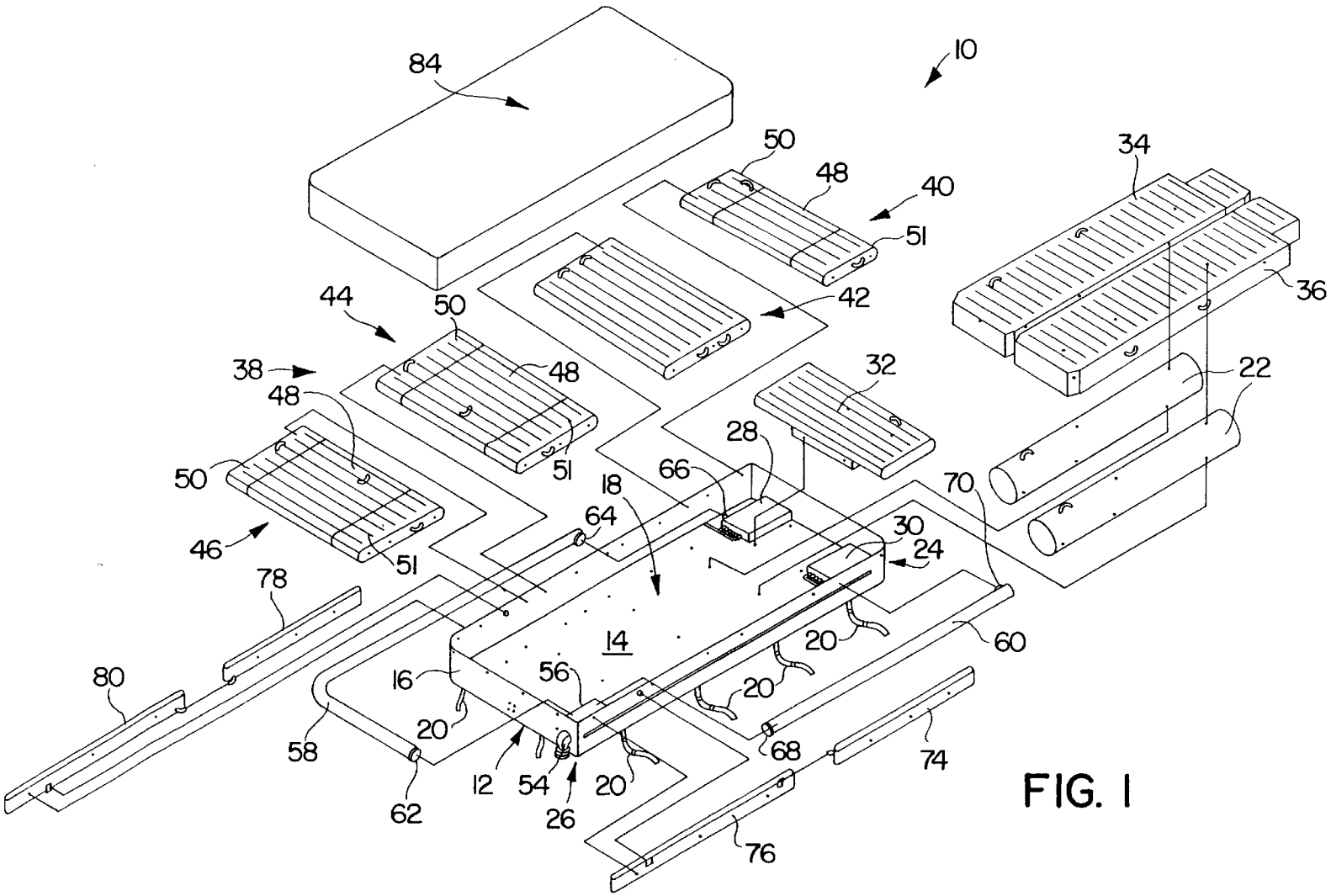
FIG. 1 is an exploded perspective view of the mattress assembly of the present invention illustrating a plurality of air cushions, air tubes, and control valves located between top and bottom covers.

Referring now to the drawings, FIG. 1 illustrates a mattress assembly 10 of the present invention. The mattress assembly 10 includes a bottom cover 12 having a bottom surface 14 and upwardly extending sidewall 16 surrounding bottom surface 14 to define an interior region 18. Straps 20 are coupled to bottom cover 12 for securing the mattress assembly 10 to a bed frame (not shown) if desired.

A plurality of air cushions are configured to be located within the interior region 18 of mattress 10. A pair of rotation cushions 22 are located on bottom surface 14. Cushions 22 are stored in a normally deflated configuration on surface 14. Rotation cushions 22 are selectively inflated and deflated to control rotation therapy of a patient located on the mattress 10.

Mattress 10 includes a head end 24 and a foot end 26. A pair of proportional valve assemblies 28 and 30 are located in interior region 18 adjacent head end 24. A lower head cushion 32 is located within interior region 18 adjacent head end 24. Lower body cushions 34 and 36 are located in the interior region 18 spaced toward the foot end 26 from lower head bladder 32.

Support surface bladders 38 are located on top of bladders 32, 34, and 36 within interior region 18. Support surface cushions 38 include a head cushion 40, a chest cushion 42, a seat cushion 44, and a foot cushion 46. Support cushions 40, 44, and 46 include inner bladder sections 48 and outer bladder sections 50 and 51 which are separately controllable from an air supply source as discussed below.

Figure 3:
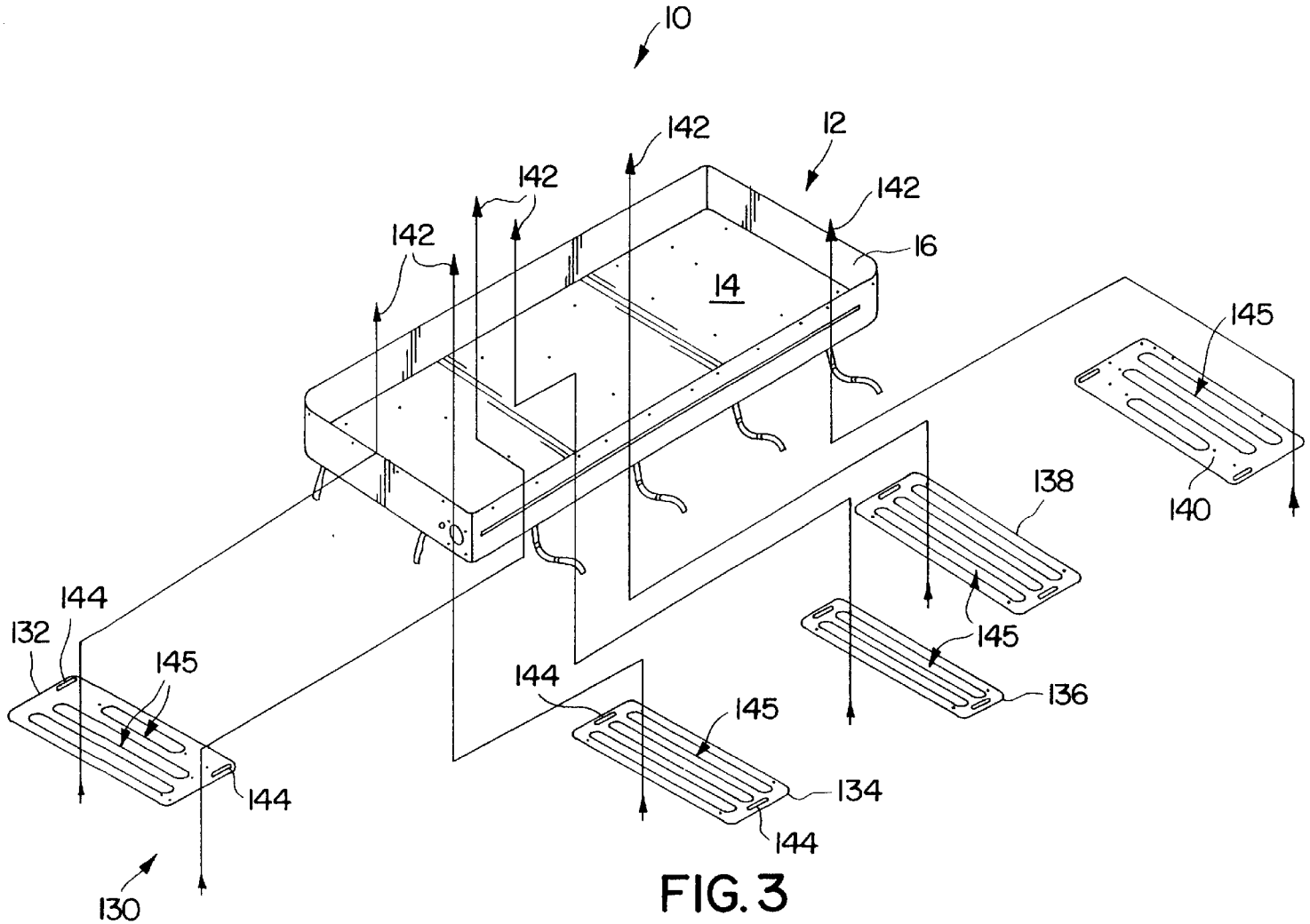
FIG. 3 is an exploded perspective view illustrating a bottom cover and a plurality of low friction plastic transfer plates configured to be coupled to the bottom cover to facilitate transfer of the mattress assembly from one bed frame to another.

Air enters the mattress assembly from a blower 52 through inlet 54. Inlet 54 is coupled to an inlet 55 of a percussion/vibration valve 56. Air supply through inlet 54 is also coupled to valves 28 and 30 via flexible, cloth tubes 58 and 60, respectively. Cloth tube 58 includes a first end 62 coupled to an outlet 57 of the manifold of valve 56 and a second end 64 coupled to a manifold inlet 66 of valve 28. Cloth tube 60 has a first end 68 coupled to an outlet 69 of the manifold of valve 56 and a second end 70 coupled to a manifold inlet 72 of valve 30 as shown in FIG. 3. A mesh tube liner is located within and extends the length of each of the cloth tubes 58 and 60 to permit a vacuum to be applied to the tubes 58 and 60 to deflate the air bladders rapidly as discussed below.

The cloth tubes 58 and 60 are illustratively two-inch diameter tubes which transfer air from the blower unit 52 to the valve assemblies 28 and 30. Cloth tubes 58 and 60 are very flexible and reduce the likelihood of kinking when moved or articulated with the mattress assembly 10 compared to conventional plastic tubes.

Figure 2:
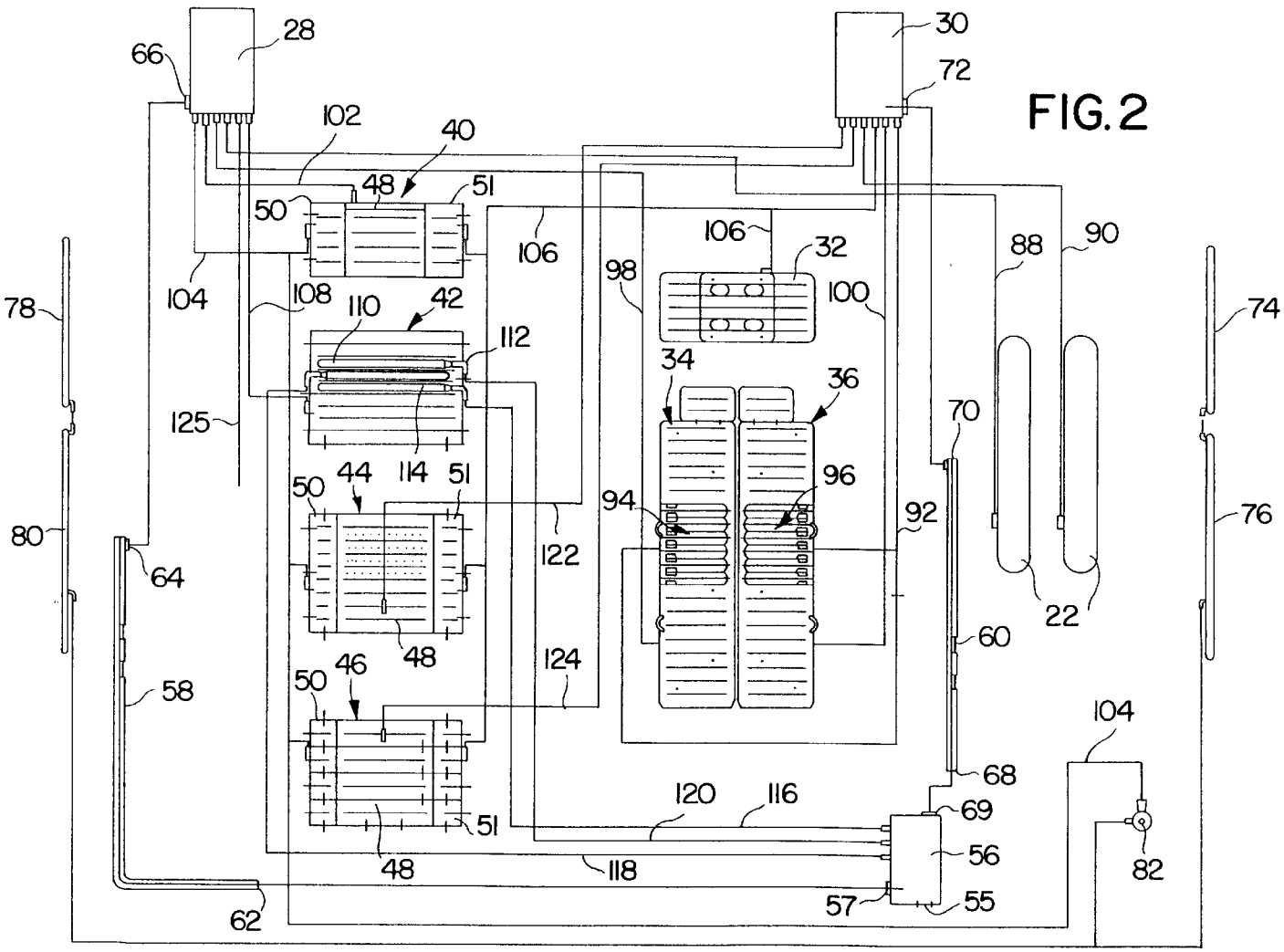
FIG. 2 is a diagrammatical view illustrating connection between the valves and the air cushions of the present invention.

Mattress assembly 10 further includes width extension cushions 74, 76, 78, and 80 which are positioned outside bottom cover 12. Cushions 74 and 78 are located on opposite sides of the mattress assembly 10 near head end 24. Cushions 76 and 80 are located on opposite sides of the mattress assembly 10 near foot end 26. As best illustrated in FIG. 2, the width extension cushions 74, 76, 78, and 80 are all coupled together and coupled to a valve 82 located near foot end 26 of mattress assembly 10. Width extension cushions 74, 76, 78, and 80 are normally inflated during operation of the mattress assembly 10. However, valve 82 may be manually opened to release air from the width extension cushions 74, 76, 78, and 80 to permit the mattress assembly 10 to be moved to a narrower frame. In other words, when a wide frame is used, the width extension bladders 74, 76, 78, and 80 are inflated. Therefore, the mattress assembly 10 can be used on frames having various widths without creating a gap between siderails of the frame and the edges of the mattress assembly 10. Typically, Med/Surg frames are wider frames. Critical care frames are typically narrower frames. Therefore, mattress assembly 10 can be used on both Med/Surg frames and critical care frames by manually opening and closing valve 82.

A top cover 84 is located all over the side wall 16 of bottom cover 12. Top cover 84 is illustratively a washable cover. The remainder of the cushions, hoses, and bottom cover are wipable for cleaning.

FIG. 2 illustrates air flow between the valves and various cushions of the mattress assembly 10. Rotation bladders 22 are coupled to valves 28 and 30 by air supply lines 88 and 90, respectively. Lower head cushion 32 is coupled to line 106 from valve 30. Lower body cushions 34 and 36 include internal bladders 94 and 96, respectively, which are each coupled to a supply line 92 from valve 30. When operation of the mattress assembly is initiated, air is supplied through supply line 92 to inflate the internal bladders 94 and 96 automatically to a predetermined pressure to reduce the likelihood that a patient will bottom out against a bed frame. Internal bladders 94 and 96 are surrounded by external bladders of lower body cushions 34 and 36. The external bladders of cushions 34 and 36 are coupled to outlets of valves 28 and 30 by supply lines 98 and 100, respectively. Therefore, external bladders of cushions 34 and 36 can be controlled by lines 98 and 100 while the internal bladders 94 and 96 remain inflated by supply line 92.

Central section 48 of head support surface cushion 40 is coupled to an outlet of valve 28 by line 102. Opposite side sections 50 and 51 of head support surface cushion 40 are coupled to valves 28 and 30 by lines 104 and 106, respectively.

Chest support surface cushion 42 is coupled to valve 28 by line 108. Chest support surface cushion includes internal percussion/vibration (P/V) bladders 110, 112, and 114. P/V bladder 110 is coupled to a first outlet of P/V valve 56 by line 116. P/V bladder 112 is coupled to a second outlet of P/V valve 56 by line 118. P/V bladder 114 is coupled to a third outlet of P/V valve 56 by line 120.

Side portions 50 and 51 of seat support surface cushion 44 are coupled to lines 104 and 106 extending from valves 28 and 30, respectively. Central portion 48 of seat support surface cushion 44 is coupled to valve 30 by line 122.

Opposite side sections 50 and 51 of foot support surface cushion 46 are coupled to supply lines 104 and 106 of valves 28 and 30, respectively. Central section 48 of foot support surface cushion 46 is coupled to valve assembly 30 by supply line 124. Supply line 104 from valve 28 is also coupled to an inlet of valve 82. An outlet of valve 82 is coupled to width extension cushions 74, 76, 78, and 80 as discussed above. Outlet line 125 is a vent hose.

If it is desired to transport a bed with a patient on the mattress assembly 10, the valves 28 and 30 are actuated to deflate the inner sections 48 of cushions 40, 44, and 46 to a reduced pressure compared to outer sections 50 and 51. The outer sections 50 and 51 of cushions 40, 44, and 46 remain inflated. Cushions 34 and 35 remain inflated. This helps cradle the patient to maintain the patient on the mattress assembly 10 during transport of the bed.

Details of the valves 28, 30, and 56 are disclosed in U.S. application Ser. No. 09/093,303 which is based on U.S. application Ser. No. 60/056,763 filed on Aug. 25, 1997, the disclosure of which is incorporated herein by reference.

FIG. 3 illustrates a plurality of transfer plates 130 which are coupled to bottom surface 14 of bottom cover 16 to facilitate transfer of the mattress assembly 10 from one bed frame to another bed frame. Transfer plates 130 include a foot plate 132, a thigh plate 134, a seat plate 136, a chest plate 138, and a head plate 140. Plates 132, 134, 136, 138, and 140 are each formed from a low friction plastic material. Plates are mounted to bottom surface 14 with suitable fasteners such as screws 142. It is understood that a plurality of fasteners 142 are used to couple each transfer plate 132, 134, 136, 138, and 140 to the bottom cover 10. It is also understood that other suitable fasteners such as rivets, snaps, etc. may be used for the plates 130. Each plate 132, 134, 136, 138, and 140 is formed to include a pair of apertures 144 which provide handle grips to facilitate transfer of the mattress assembly 10. Each plate 132, 134, 136, 138, and 140 is also formed to include a plurality of elongated apertures 145. The transfer plates 130 are used to reduce the friction while sliding the mattress assembly 10 from one bed frame to another to permit transfer without disrupting a patient lying on the mattress assembly 10.

Figure 4:
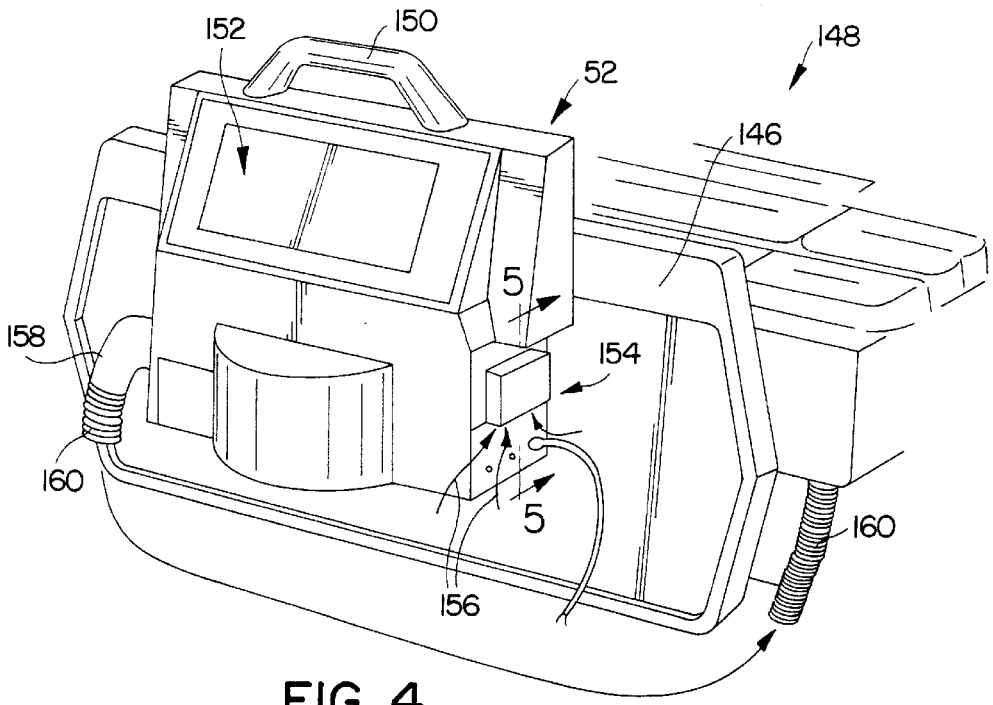
FIG. 4 is a perspective view illustrating a blower housing coupled to a foot board of a bed for supplying air to the mattress assembly.

Blower assembly 52 is configured to hang on to a foot board 146 of a bed 148 as shown in FIG. 4. The blower assembly 52 includes a handle 150 and a touch screen control display 152. The touch screen control display 152 permits an operator to control operation of the blower 152 and valves 28, 30, and 56 to control therapies of the mattress assembly 10. A main microprocessor of the assembly is included within the blower housing. In addition, a blower motor and a power supply are located within the blower housing.

Figure 6:
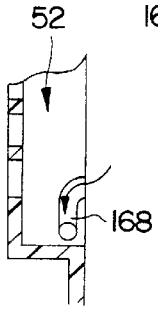
FIG. 6 is a partial sectional view illustrating a slot formed in the blower housing for receiving a corresponding pin formed on the air intake manifold.
Figure 7:
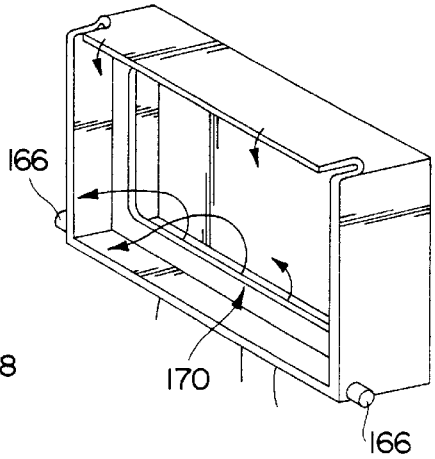
FIG. 7 is a perspective view illustrating further details of the air intake manifold.

Air enters the blower housing 52 through intake manifold 154 in the direction of arrows 156. Air exits blower assembly 52 through outlet connector 158 and passes through air hose 160 to the inlet of manifold of valve 56. Manifold 154 is configured to reduce air intake noise into blower assembly 52. Manifold 154 includes a rear wall 162 defining an inlet 164 along a bottom surface of manifold 154. Pegs 166 on opposite sides if manifold 154 are configured to couple the manifold 154 to the blower housing 52 by entering slots 168 as shown in FIG. 6.

Manifold 154 includes an internal lip 170 to retain a filter 172 in the manifold 154. In the illustrated embodiment, the blower housing 52 includes a recessed portion 174 for receiving the manifold 154. A grate 176 permits inlet air to pass into the blower housing 152 in the direction of arrows 178. The grate 176 is not required. In other words, an opening can be formed in blower housing 152 without the grate 176.

Figure 5:
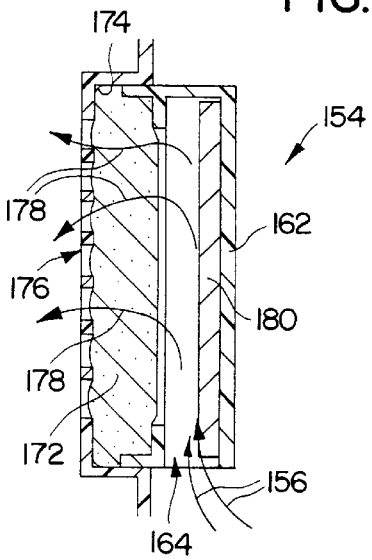
FIG. 5 is a sectional view taken along lines 5—5 of FIG. 4 illustrating an air intake manifold coupled to the blower housing.

As best illustrated in FIG. 5, manifold 154 deflects inlet air entering the blower housing 52 in the direction of arrows 156 by an angle of 90°. This directional change reduces air intake noise. A layer of sound foam 180 is located along rear wall 162 to further reduce air intake noise.

Figure 8:
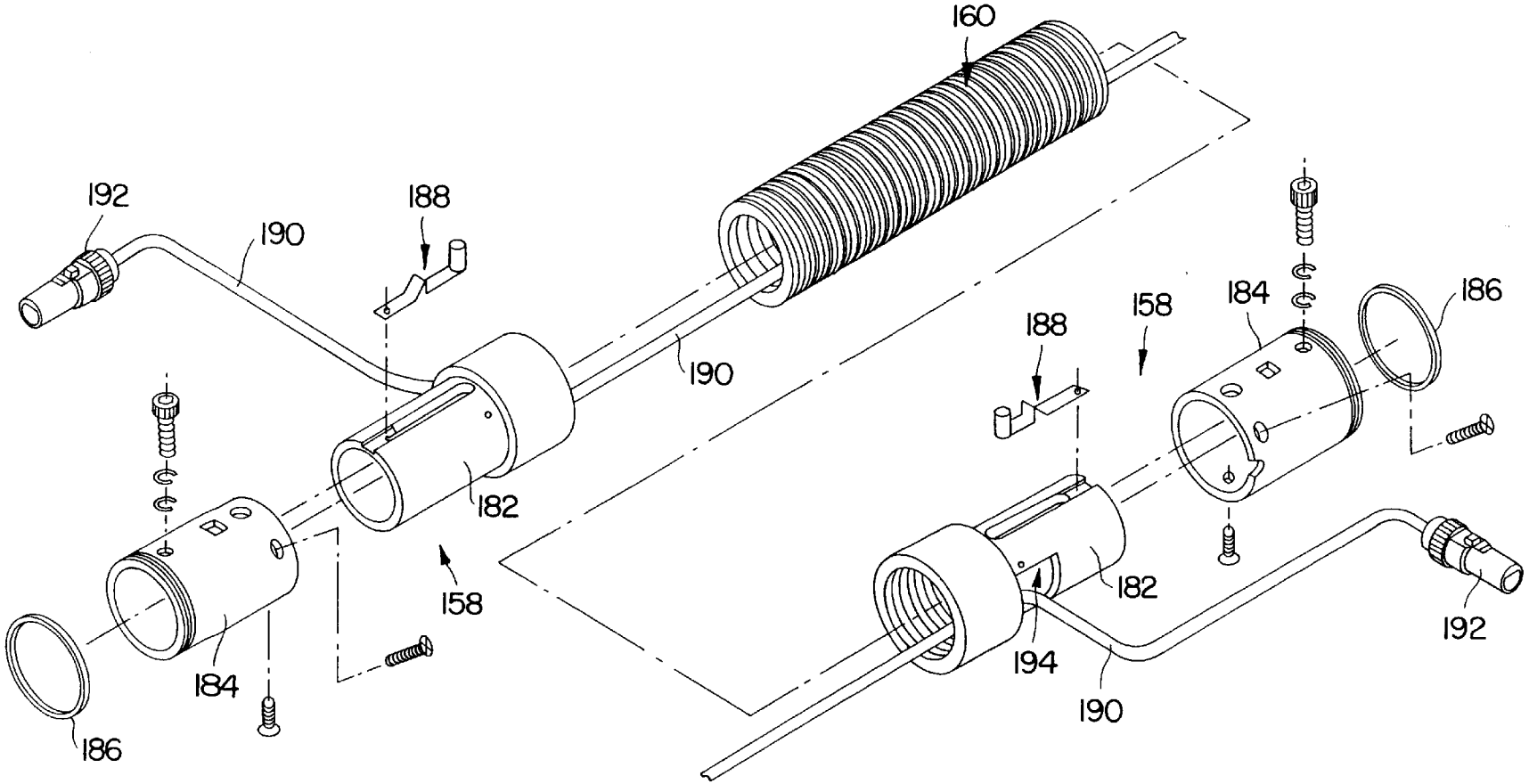
FIG. 8 is an exploded perspective view illustrating details of an air hose assembly extending between the blower housing and the mattress assembly which includes an internal electrical cord for transmitting control signals from the blower housing control panel to the mattress assembly.
Figure 9:
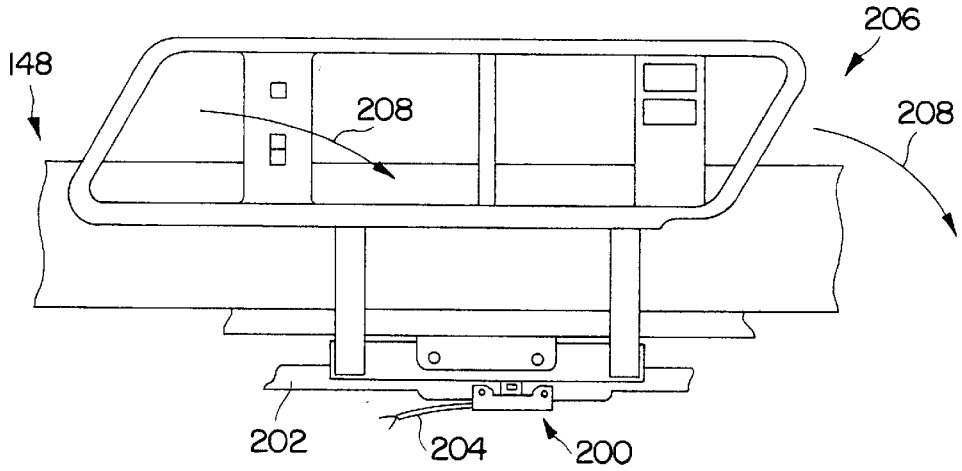
FIG. 9 is a partial side elevational view illustrating a siderail of a bed and a siderail down sensor coupled to a frame below the siderail.

Another feature of the present invention is illustrated in FIG. 8. The air supply hose 160 includes air connectors 158 at each end. Connectors include a hose fitting 182, an outer sleeve 184, and an O-ring 186. A spring release 188 is provided to lock the fittings 158 in place. An electrical cable 190 includes electrical connectors 192 at opposite ends. Cable 190 is inserted through openings 194 and fittings 182 so that the cable 190 extends through the air tube 160 from the blower housing 152 into the inside of mattress assembly 10. Therefore, cable 190 is not exposed. One connector 192 is coupled to the electrical circuit of the blower assembly 52 and the other connector 192 is coupled to the electrical circuit within the mattress assembly 10. When the fittings 182 and 184 are assembled, the fittings 182 and 184 clamp the cable 190 to provide strain relief for the cable 190.

If it is desired to quickly deflate the plurality of air cushions within the mattress assembly 10, the fitting 158 can be removed from an air outlet of the housing 52 and the manifold 154 can be removed from the air inlet of the blower housing 52. The fitting 158 coupled to air hose 160 is then connected to a female receptacle molded into the housing 52 at the air inlet so that air may be removed rapidly from the plurality of air cushions of the mattress assembly 10.

Another feature of the present invention is illustrated in FIGS. 9–13. The present invention includes a siderail down sensor 200 coupled to a frame 202 of bed 148. The siderail down sensor 200 is configured to provide an output signal over signal line 204 when the siderail 206 of bed 148 is moved downwardly in the direction of arrows 208.

Figure 10:
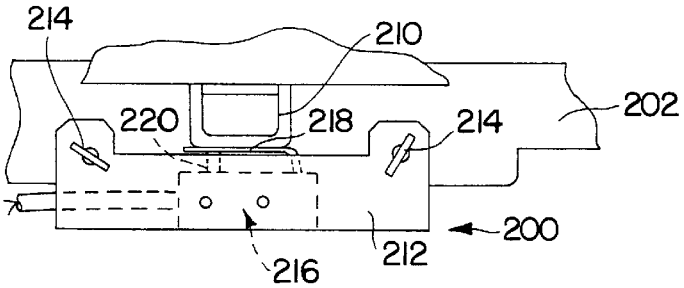
FIG. 10 is an enlarged side elevational view illustrating a switch of the siderail down sensor which is closed when the siderail is in its upwardly pivoted position.
Figure 11:
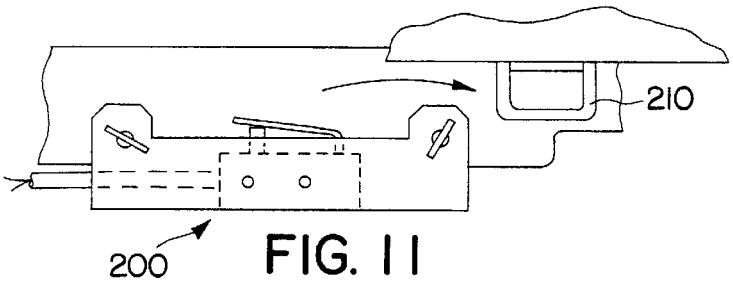
FIG. 11 is a side elevational view similar to FIG. 10 illustrating the sensor switch in an open position when the siderail is pivoted downwardly.

As illustrated in the enlarged views in FIGS. 10 and 11, the frame includes a support member 210 movable from the position over sensor apparatus 200 when the siderail is up to the position spaced apart from sensor apparatus 200 when the siderail is down. Sensor 200 includes a body 212 and fasteners 214 for securing the body 212 to the frame 202. Sensor 200 also includes a switch assembly 216 having an actuator arm 218 which closes and opens a switch 220 as the siderail 206 moves from its up position illustrated in FIG. 9 to the down position. In other words, when the switch 220 is open as shown in FIG. 11, an output signal is generated to indicate that the siderail 206 is down. When the controller receives a siderail down signal from sensor 200, certain therapies of the mattress assembly 10 are disabled. For instance, rotational therapy is discontinued upon detection of the siderail being down by sensor 200.

Figure 12:
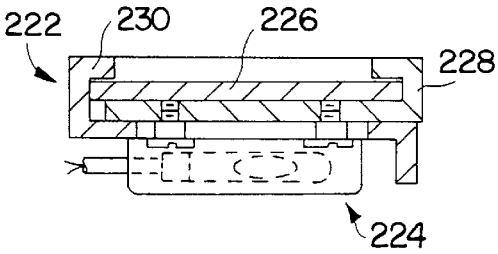
FIG. 12 is a sectional view taken through another embodiment of the siderail down indicator which clips on a frame member of the siderail.
Figure 13:
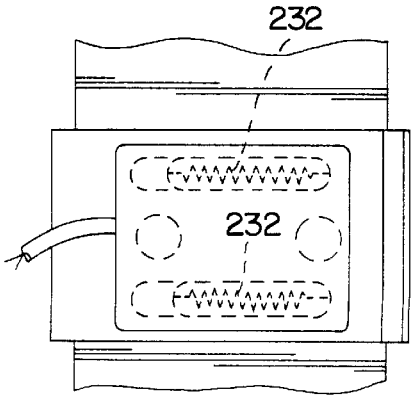
FIG. 13 is a side elevational view of the siderail down indicator of FIG. 12.

Another embodiment of the siderail down sensor is illustrated in FIGS. 12 and 13. In this embodiment, a clip assembly 222 is provided for securing the sensor 224 to the siderail 206. Specifically, the clip assembly 222 is configured to mount the sensor 224 to a support frame 226 of siderail 206. Clip assembly 222 includes a first body portion 228 slidably coupled to a second body portion 230. First and second body portions 228 and 230 are biased toward each other by springs 232. Illustratively, sensor 224 is a ball switch or a mercury switch.

Angle sensors are provided within the mattress assembly 10 so that the microprocessor can determine the articulation angle for a head section 24 of the mattress assembly 10. A first sensor such as an accelerometer is located in a seat section of the mattress assembly 10. A second sensor such as an accelerometer is coupled to a bottom surface of one of the valves 28 or 30 located within the head section 24 of the mattress assembly 10. The seat section accelerometer provides a reference output since the seat section does not articulate. Therefore, a zero reading can be taken from the seat sensor. As the head of the bed is articulated, the head sensor detects such movement and compares its new position to the reference position from the sensor in the seat section. The seat section sensor can accommodate movement to the Trendelenburg and reverse Trendelenburg position so that the angle of the head section of the mattress relative to the seat section can always be detected during articulation of the mattress assembly 10 on a bed frame.

Although the invention has been described in detail with reference to a certain illustrated embodiment, variations and modifications exist within the scope and spirit of the present invention as described and defined in the following claims.

What is claimed is:

1. A mattress apparatus for use on a bed frame having at least one siderail movable from an up position to a down position, the apparatus comprising:

a support surface;

an electrical controller configured to control the support surface; and a siderail down sensor configured to be coupled to one of the bed frame and siderail, the siderail down sensor being electrically coupled to the controller, the siderail down sensor being configured to generate an output signal indicating that the siderail of the bed frame is in the down position.

2. The apparatus of claim 1, wherein the siderail down sensor includes a mercury switch.

3. The apparatus of claim 1, wherein the siderail down sensor includes a ball switch.

4. The apparatus of claim 1, wherein the sensor includes an accelerometer.

5. The apparatus of claim 1, wherein the siderail down sensor includes a switch and an attachment mechanism configured to couple the sensor to the bed frame adjacent the siderail, the siderail being configured to actuate the switch and generate an output signal as the siderail moves from an up position to a down position.

6. The apparatus of claim 1, wherein the switch of the siderail down sensor is configured to be closed when the siderail is in the up position.

7. The apparatus of claim 1, wherein the siderail down sensor includes first and second plates slidable relative to each other, the first and second plates being spring biased together to clamp the siderail down sensor to the siderail.

* * * * *